US009435100B2

(12) United States Patent
Horton

(10) Patent No.: US 9,435,100 B2
(45) Date of Patent: Sep. 6, 2016

(54) HIGH PRODUCTION ROCK RIPPING TOOL

(71) Applicant: Lee A. Horton, Jefferson, MA (US)

(72) Inventor: Lee A. Horton, Jefferson, MA (US)

( * ) Notice: Subject to any disclaimer, the term of this patent is extended or adjusted under 35 U.S.C. 154(b) by 0 days.

(21) Appl. No.: 14/630,921

(22) Filed: Feb. 25, 2015

(65) Prior Publication Data

US 2015/0247302 A1 Sep. 3, 2015

Related U.S. Application Data

(60) Provisional application No. 61/946,203, filed on Feb. 28, 2014.

(51) Int. Cl.

| | |
|---|---|
| ***E02F 3/40*** | (2006.01) |
| ***E02F 5/32*** | (2006.01) |
| ***E02F 9/28*** | (2006.01) |

(52) U.S. Cl.

CPC . *E02F 3/40* (2013.01); *E02F 5/32* (2013.01); *E02F 9/2858* (2013.01); *E02F 9/2875* (2013.01)

(58) Field of Classification Search

CPC ..... E02F 3/40; E02F 5/32; E02F 9/2858; E02F 9/2875

USPC ..... 37/404, 444

See application file for complete search history.

(56) References Cited

U.S. PATENT DOCUMENTS

| | | | | |
|---|---|---|---|---|
| 3,724,899 | A * | 4/1973 | Clark | E02F 5/025 299/26 |
| 4,037,337 | A * | 7/1977 | Hemphill | E02F 3/3604 37/444 |
| 4,077,529 | A * | 3/1978 | Leyrat | E02F 3/962 37/404 |
| 4,133,121 | A * | 1/1979 | Hemphill | E02F 3/3604 37/444 |
| 4,279,085 | A | 7/1981 | Arnold | |
| 4,457,085 | A | 7/1984 | Arnold | |
| 7,086,184 | B2 * | 8/2006 | Archuleta, Jr. | E02F 3/40 37/404 |
| 7,322,133 | B2 * | 1/2008 | Horton | E02F 3/40 37/404 |
| 7,739,815 | B2 | 6/2010 | Horton | |
| 8,966,791 | B2 * | 3/2015 | Horton | E02F 3/40 37/444 |
| 2007/0180743 | A1 * | 8/2007 | Horton | E02F 3/8152 37/404 |
| 2008/0010870 | A1 * | 1/2008 | Horton | E02F 3/40 37/444 |
| 2011/0126434 | A1 * | 6/2011 | Horton | E02F 3/40 37/444 |

* cited by examiner

*Primary Examiner* — Jamie L McGowan
(74) *Attorney, Agent, or Firm* — Fish & Richardson P.C.

(57) ABSTRACT

A rock ripping tool mountable to an excavation machine for engagement with a substrate has a rotatable tool body, a pair of side plates and a curved back plate mounted to the body, a bottom plate with an angled leading edge mounted to span a space between side plates, and a plurality of teeth, including a first set mounted to the front edge, the tip of each tooth lying on an arc having a first radius, a second set mounted to the bottom and/or back plate, the tip of each tooth lying an arc having a second radius greater than the first radius, and a third set of teeth mounted to the bottom plate and/or the back plate, with the tip of each tooth lying on an arc having a third radius greater than the first and second radii. Each tooth is configured to engage the substrate sequentially and individually.

13 Claims, 7 Drawing Sheets

HIGH PRODUCTION ROCK RIPPING TOOL

This application claims priority from U.S. Provisional Application No. 61/946,203, filed Feb. 28, 2014.

TECHNICAL FIELD

This invention relates to high production rock ripping tools, and more particularly to bucket type excavation and ripping tools for excavators and backhoes.

BACKGROUND

Excavation tools of the types described herein are typically mounted to conventional excavators or backhoes having a dipper stick, with the tool mounted on the dipper stick. The tools are employed for excavation of difficult-to-excavate intermediate substrate, e.g. substrate between the category of loose soil or loose gravel and the category of solid rock. Attempts have been made to develop tools that are effective and efficient in excavating intermediate substrate. For example, an excavation tool for the removal of substrate is described in Horton U.S. Pat. No. 7,739,815, and a multi-tooth bucket approach where several teeth are mounted on the back side of a bucket is described in Arnold U.S. Pat. Nos. 4,279,085 and 4,457,085. The complete disclosures of all of these references are incorporated here by reference. Each of these approaches has been found to have drawbacks, and none is seen to be particularly efficient or effective for excavation of intermediate substrate with high production, wide width, high capacity buckets.

SUMMARY

According to one aspect of the disclosure, a rock ripping tool mountable to an arm of an excavation machine for ripping engagement with a substrate comprises a tool body mounted for rotation from the arm, a pair of side plates and a curved back plate mounted to the tool body, a bottom plate having an angled front leading edge and mounted to span a space between the side edge plates, and a plurality of teeth comprising a first set of two or more teeth mounted to the angled front leading edge such that the tips of each tooth of the first set of two or more teeth lies on an arc having a first radius, a second set of one or more teeth mounted to at least one of the bottom plate and/or the back plate, such that the tips of each tooth of the second set of one or more teeth lies on an arc having a second radius greater than the first radius.

Implementations of this aspect of the disclosure may include one or more of the following additional features. The first radius and the second radius intersect at a common axis of the ripping tool. The rock ripping tool comprises at least a third set of one or more teeth mounted to the bottom plate and/or the back plate, such that the tips of each tooth of the third set of one or more teeth lies on an arc having a third radius greater than the first radius and greater than the second radius. Each tooth of the plurality of teeth is angled such that an angle between a line bisecting the tooth and a line perpendicularly bisecting the respective arc where the tip of the tooth lies on the arc is at an optimum angle. Each tooth in the plurality of teeth is at the optimum angle. The optimum angle is in the range of about 35° to about 70°, e.g. the optimum angle is approximately 50°. The second set of teeth rips the substrate in a path between the paths of the teeth of the first set of two or more teeth. The side plates can have leading edges that define cutting profile edges. A lower portion of the back plate defines an outer surface lying on a radius having a center coaxial with at least one of the first radius and the second radius. Each tooth of the plurality of teeth is configured to engage the substrate sequentially and individually from each other tooth.

According to another aspect of the disclosure, a rock ripping tool having a tool body and mountable to an arm of an excavation machine for ripping engagement with a substrate comprises a first set of teeth comprising at least two teeth mounted to the tool body such that the tips of each of the at least two teeth of the first set of teeth lies on an first arc having a first radius, and a second set of teeth comprising at least one tooth mounted to the tool body such that the tip of each tooth of the at least one tooth of the second set of teeth lies on an second arc having a second radius greater than the first radius, wherein each tooth of the plurality of teeth is configured to engage the substrate independently from each tooth in the first set of teeth and each tooth in the second set of teeth.

Implementations of this aspect of the disclosure may comprise at least a third set of one or more teeth mounted to the bottom plate and/or the back plate, such that the tips of each tooth in the third set of one or more teeth lies on an arc having a third radius greater than the first radius and greater than the second radius.

Advantages of the new rock ripping tool include that the tool can have a relatively wider bucket, e.g. to increase production without increasing the number of teeth on the front leading edge. Rather, by providing teeth at the back of the bucket, i.e. behind the leading edge, deeper cuts can be made with each pass, thus reducing or eliminating grooves in the substrate material, while keeping a relatively large side view engagement angle between the teeth, assuring one tooth at-a-time engagement. The back teeth are arranged to cut relatively deeper, i.e. as compared to the teeth at the leading edge, with increased radii, also resulting in increased production. Since the number of teeth is relatively increased, the wear on each tooth is proportionately reduced. The rock ripping tool of the disclosure is designed in particular for use in ripping medium hard rock.

The details of one or more embodiments of the disclosure are set forth in the accompanying drawings and in the description below. Other features, objects and advantages of the invention will be apparent from the description and drawings, and from the claims.

DESCRIPTION OF DRAWINGS

Like reference symbols in the various drawings indicate like elements.

DETAILED DESCRIPTION

Figure 1:
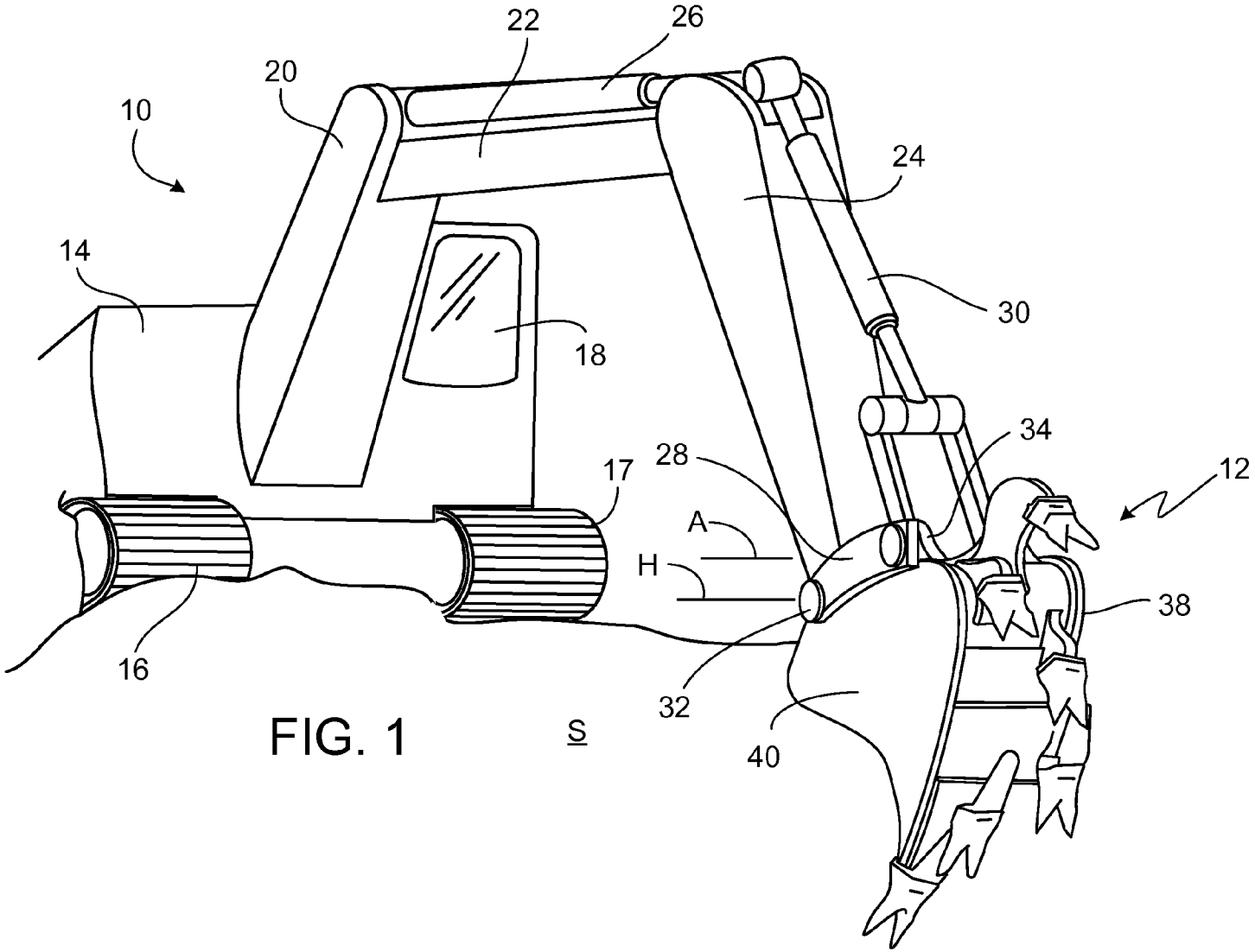
FIG. 1 is a somewhat schematic representation of a hydraulic excavator fitted with an example of the high production rock ripping tool of this disclosure.

Referring first to FIG. 1, a hydraulic excavator 10, e.g. of the type suited for use with a high production rock ripping tool 12 of the disclosure, has a chassis 14, tracks 16 and 17 for mobility, and a cab 18 for an operator. Extending from the chassis 14 is a boom 20 pivotally attached to the chassis 14 and a dipper stick 24 pivotally attached to the outboard end of the boom. A hydraulic actuator 26 articulates the dipper stick 24. A high production rock ripping tool 12 can be mounted to the outboard end of the dipper stick 24 of the hydraulic excavator 10 by means of a quick-change coupler mechanism 28, or it can be mounted directly to the dipper stick and linkage. A second hydraulic actuator 30 articulates the high production rock ripping tool 12 generally about an axis, H (see, also, FIG. 6). A second axis, A, is an imaginary axis that is a combination of the rotational axis translation, which is preferably located near and generally above and forward of the dipper pivot rotation center, i.e., the axis, H, of hinge pin 32, e.g. for ripping engagement, e.g., with the medium hard substrate, S.

Referring also to FIGS. 2 through 6, the high production rock ripping tool 12 has a tool body including a tool body upper portion 34, constructed for secure, releasable connection to the lower side of the quick-change mechanism 28 (FIG. 1). The quick-connect coupler mechanism 28, in turn, is connected to the dipper stick 24 and the hydraulic actuator 30 (FIG. 1), or the tool can be connected directly to the dipper stick. Connected to the tool body upper portion 34 are two or more plates 36 that together generally form a tube. A set of rear and front side edge plates 38, 40 are mounted at respective upper ends to opposite ends of the tool body upper portion 34. Each side edge plate 38, 40 extends generally perpendicular to the axis, A, of the high production rock ripping tool 12. A curved back plate 42 is mounted to span a region between the side edge plates 38 and 40. Also spanning side edge plates 38, 40, at a bottom aspect of the tool 12, opposite the tool body upper portion 34, a rear bottom plate segment 44 and mid bottom plate segment 46. Also partially spanning the bottom of the rock ripping tool 12 is a front bottom plate segment 48. The front bottom plate segment 48 is forward of the mid bottom plate segment 46, which is forward of the rear bottom plate segment 44. The front bottom plate segment 48 is attached to a bottom front portion of the forward side edge plate 40, approximately perpendicular to the second forward edge plate 40. As best seen, e.g., in FIGS. 2 and 4, the rear bottom plate segment 44, mid bottom plate segment 46, and front bottom plate segment 48 do not necessarily lie on a plane and rather are angled relative to each other. In other implementations, the bottom plate 43 may be formed as a single, e.g. bent, plate having angled portions.

Figure 2:
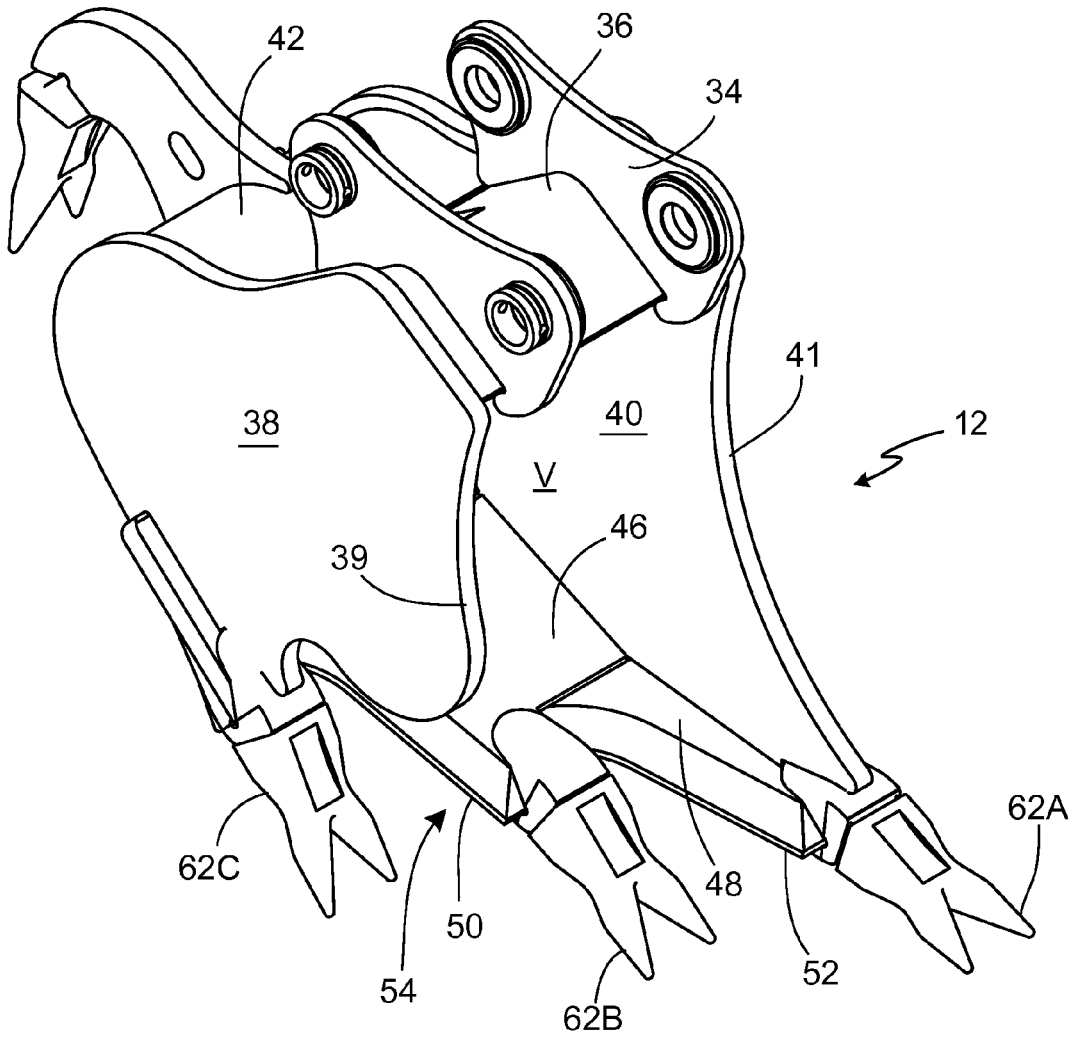
FIG. 2 is a left front perspective view of the high production rock ripping tool of FIG. 1

Referring, e.g., to FIG. 2, the mid bottom plate segment 46 and front bottom plate segment 48 each has a plate leading edge 50, 52 that together form a discontinuous front leading edge 54 for cutting engagement with the substrate, S. The front leading edge plate 54 is angled laterally by angle, B, of FIG. 3, e.g. about 10° to about 35°. The angled front leading edge plate 54 may or may not have teeth mounted thereto; however, in the implementation shown in the present drawings, a first set of front teeth 60 is mounted to the front leading edge plate 54. The side edge plates 38, 40, and teeth 62 of the first set of teeth 60, are laterally spaced apart along the axis A, and the teeth are positioned in a direction of substrate-engagement motion.

Figure 3:
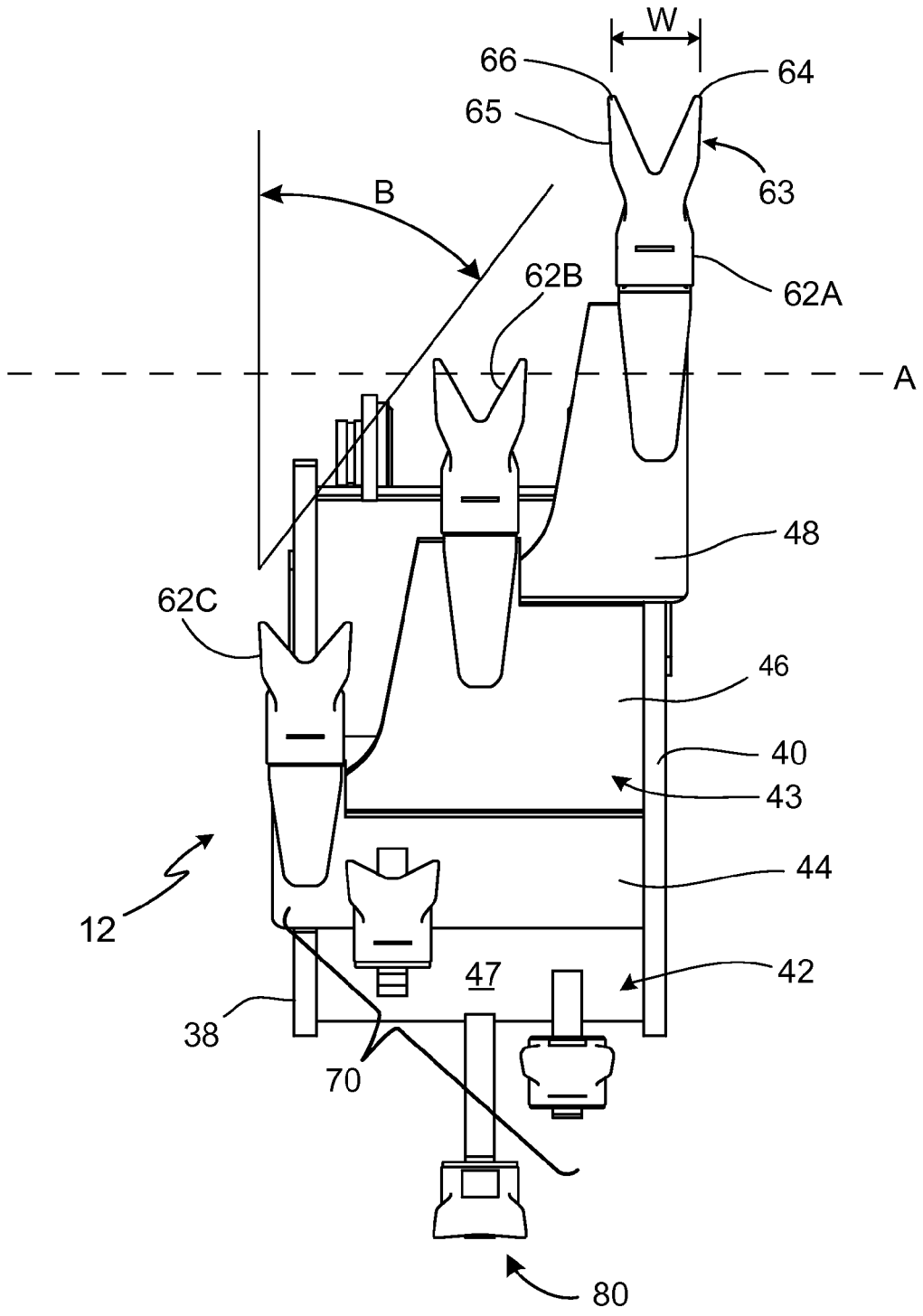
FIG. 3 is a bottom view of the high production rock ripping tool of FIG. 1.

The side edge plates 38, 40 can be beveled at their front aspect, e.g. to provide side cutting edges, and are shaped, thus providing a rearward side leading edge 39 and tooth 62C and a forward side leading edge 41 and tooth 62A that are spaced apart and approximately parallel to each other along the axis, A, e.g. as shown in FIGS. 2 and 3. Additional tooth 62B is intermediately spaced along the front leading edge 54 at the front-most portion of mid bottom plate segment 46.

The plate leading edges 50, 52 of front leading edge 54 are also beveled to provide forward bottom cutting edges for cutting the packed substrate S. Additionally, the plate leading edges 50, 52 of front leading edge 54 can be scalloped, e.g. to help slice through the hard packed substrate, as shown, e.g., in FIG. 2.

Figure 4:
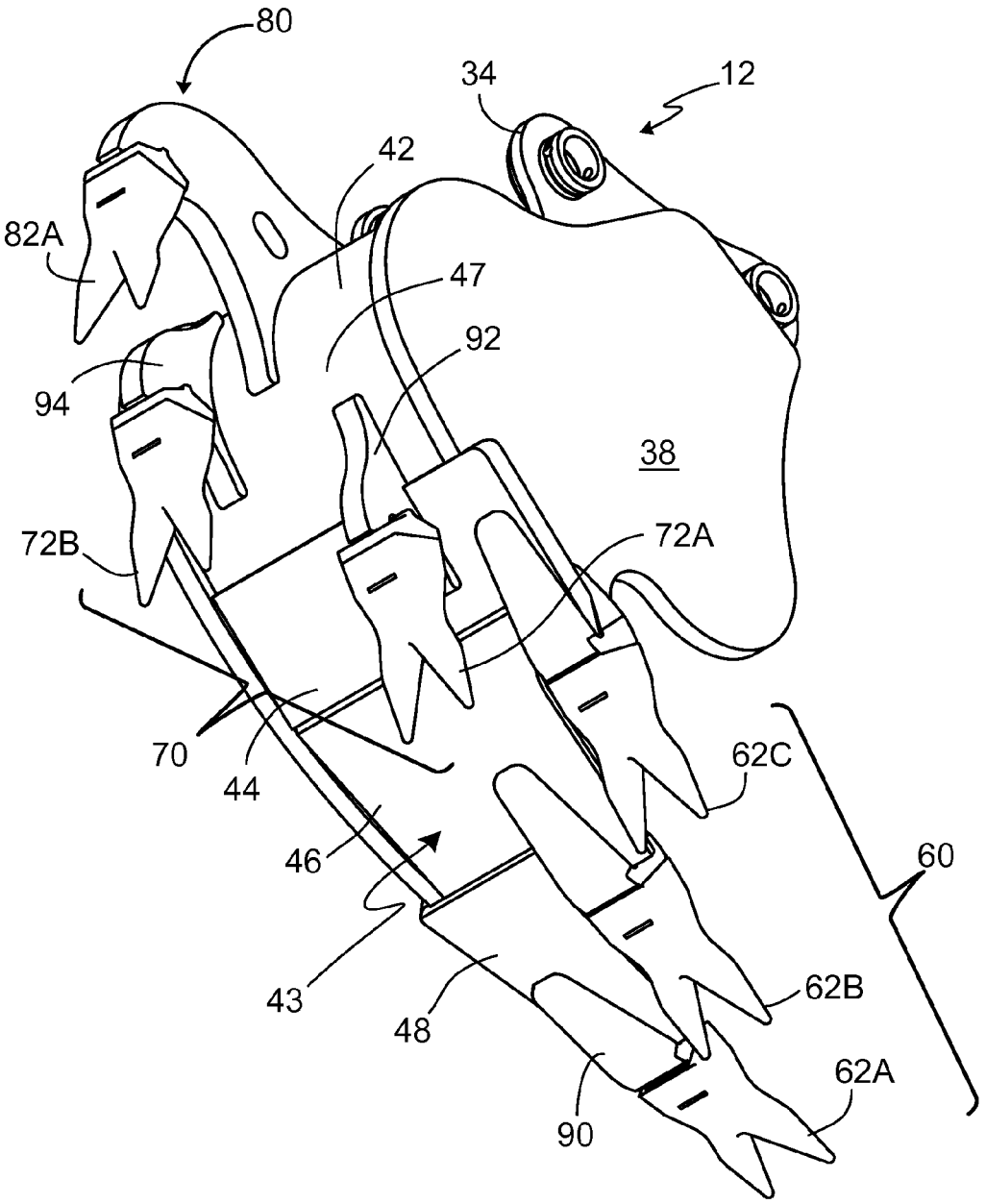
FIG. 4 is a left rear perspective view of the high production rock ripping tool of FIG. 1.
Figure 5:
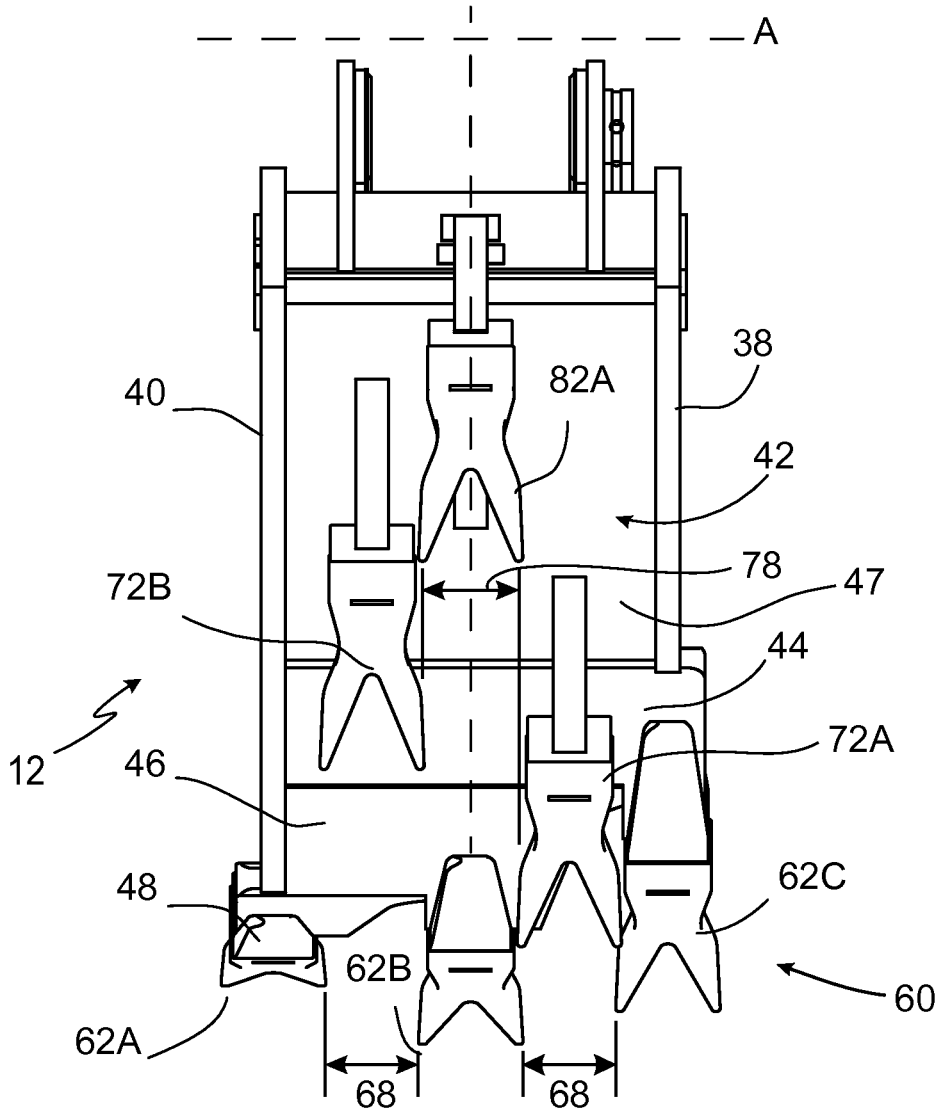
FIG. 5 is a rear view of the high production rock ripping tool of FIG. 1.

Referring further to FIGS. 3-5, in preferred implementations, the rock ripping tool 12 has three sets of removable teeth 60, 70, 80 mounted to the high production rock ripping tool 12. The first tooth set 60 includes three teeth 62A, 62B, 62C, which are mounted along on the front leading edge 54. Each of the teeth 62A, 62B, 62C of the first set of teeth 60 is mounted to a tooth adapter 90, respectively, which is easily welded at the tip of the associated side edge plate 38 or the forward edge s of the rear, mid, and/or front bottom plate segments 44, 46, 48, respectively, or the bottom plate 43. Two teeth 72A, 72B, in a second tooth set 70, are mounted on tooth adaptors 92, 94 positioned to the bottom and rear of the rock ripping tool 12. The forward tooth 72A of the second tooth set 70 is mounted to the rear bottom plate segment 44, and the rearward tooth 72B of the second tooth set 70 is mounted to the curved back plate 42. A third tooth set 80 contains a single tooth 82A, which is mounted upon a highly curved tooth adaptor 96 positioned at the rear of curved back plate 42.

Figure 6:
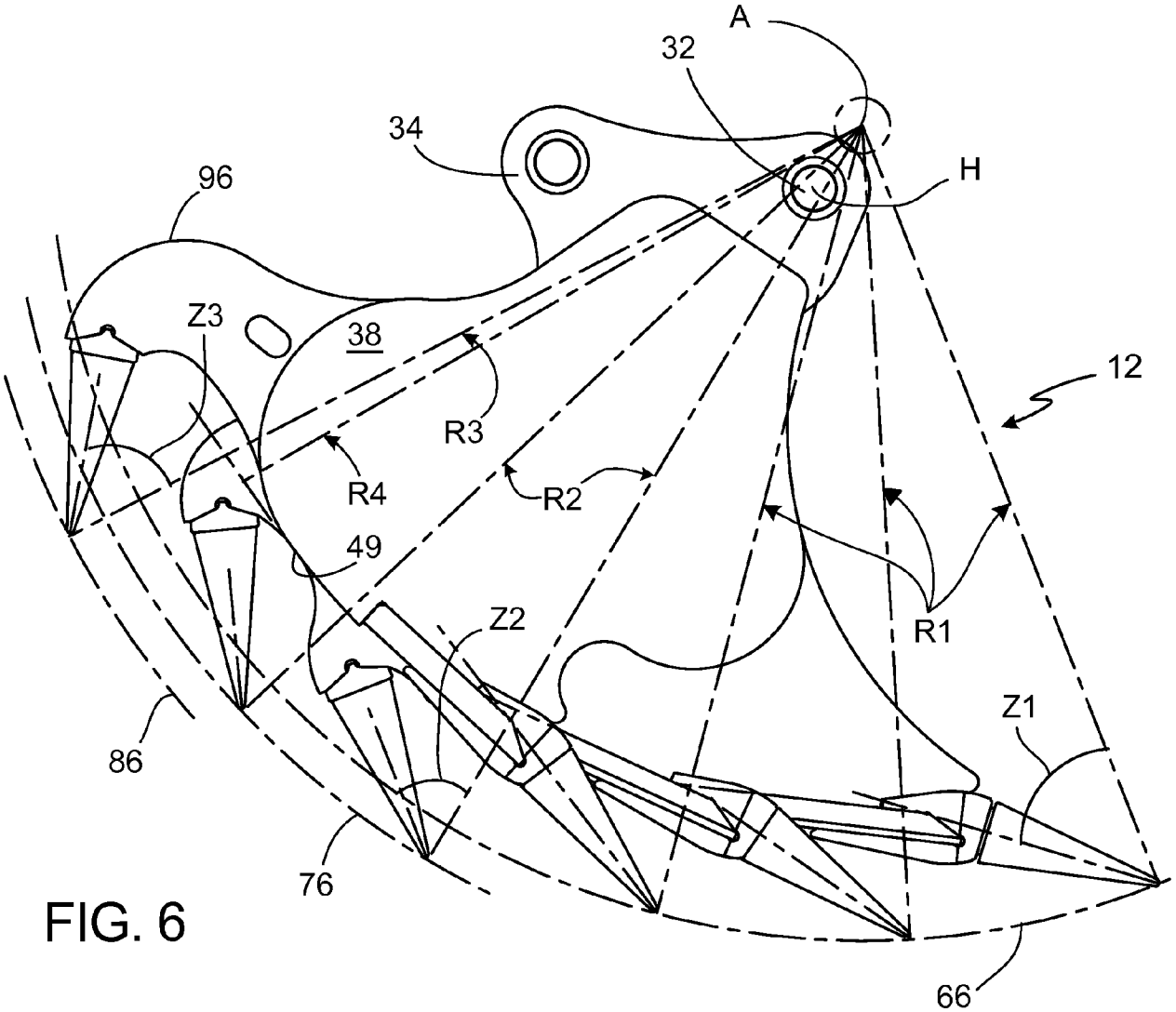
FIG. 6 is an enlarged side view of the ripping excavation tool of FIG. 1, e.g. a high production rock ripping tool of the disclosure, having multiple ripping teeth mounted to the tool in an arrangement with angular spacing between ripping teeth in a general direction of substrate ripping motion.

Referring to FIG. 6, the three teeth 62A, 62B, 62C of first tooth set 60 are all positioned to lie on arc 66 having a radius, R1, centered on axis, A, near and generally above and forward of the dipper pivot rotation center, i.e. axis, H, of hinge pin 32. The two teeth 72A, 72B of the second tooth set are positioned to lie on arc 76 having the same center, A, as arc 66, but with a relatively larger radius, R2. The tooth 82A of the third tooth set 80 is positioned to lie on arc 86, also of the same center, A, and having a radius, R3, larger than either of the radius, R1, and radius, R2. As seen from the side, the teeth are not positioned to lie in a common plane. Each tooth is spread at a similar engagement angle, e.g., about 15 to 18 degrees, to approximately equally spread the teeth for engagement with the substrate, S.

Each set of teeth 60, 70, 80 is angled such that an angle Z1, Z2, Z3 for each set of teeth, being the angle between the bisection of each tooth and the radii R1, R2, R3 of the respective arcs 66, 76, 86, is optimized to provide maximum penetration in the substrate. That is, all of the teeth are angled such that angles Z1, Z2, Z3 are equalized to an optimum ripping angle, Z. The optimum angle, Z, depends on tooth manufacture, but typically lies in the range of about 35° to about 70°, or approximately 50°.

Referring to FIG. 5, the three teeth 62A, 62B, 62C, i.e. of the first tooth set 60, are positioned to be laterally spaced from each other generally along the axis, A, of the high productions rock ripping tool 12. In this implementation, the ripping teeth 62A, 62B, 62C are equally spaced apart from each other, creating generally uniform intervening gaps 68.

The next two teeth 72A, 72B, i.e. of second tooth set 70, are positioned to be laterally spaced apart from each other generally along the axis, A, creating intervening gap 78 between the two teeth. In this implementation, the teeth 72A, 72B are equally spaced apart and span the width of the tool 12. The two teeth 72A, 72B are also laterally positioned between the front three teeth 62A, 62B, 62C, i.e. in the intervening gaps 68 between the teeth of the first tooth set 60.

The rear tooth 82A, i.e. of the third tooth set 80, is positioned near the lateral center of the tool, i.e., within intervening gap 78 between teeth 72A, 72B.

Referring in particular to FIG. 3, each tooth 62A, 62B, 62C of the disclosure has a first ripper tooth portion 63, terminating in a first ripper tooth tip 64, and at least a second ripper tooth portion 65, terminating in a second ripper tooth tip 66. The twin or double tiger points or tips 64, 66 of first and second ripper tooth portions 63, 65, respectively, are dimensionally spaced apart along the axis, A, by a dimension, W, e.g. about one-third of the length of the tooth.

The edge plates 38, 40 with the bottom plate 43, consisting of rear bottom plate segment 44, mid-bottom plate segment 46, and front bottom plate segment 48, provide a bucket volume, V (FIG. 2), of predetermined capacity for receiving material excavated from the substrate, S. The bucket volume, V. can be about 0.1 cubic yard for use with a mini (e.g., 6,000 pound weight) excavator to 6 or more cubic yards for use with a large (e.g., 300,000 pound) excavator. The rearward side edge plate 38 is shaped to support the bottom plate segments 44, 46 and tooth adapter 90 (to which a tooth 62A is mounted, e.g. by pins (not show)), while also limiting side spillage, thus providing for maximum capacity of excavated substrate material. The width of the high production rock ripping tool 12 may be made larger than other rock ripping buckets, thereby permitting increased capacity. For example, the width of the tool can be 18 inches for use with a mini (e.g., 6,000 pound weight) excavator to 72 inches for use with a large (e.g., 300,000 pound) excavator. The bucket volume, V, of the high production rock ripping tool 12 fills and empties easily, thereby permitting the operator to scoop excavated materials efficiently.

The high production rock ripping tool of FIG. 1 thus improves the efficiency of excavating hard packed substrate, e.g. when compared to prior art tools, by focusing the breakout force one tooth at a time. As the operator is excavating hard packed substrate, the tool is rolled toward the operator such that the first tooth 62A alone engages the material first. The concentration of machine breakout force on one tooth provides a concentration of the forces that are high enough to easily break up hard packed substrate, S, such as medium hard rock.

During operation, the high production rock ripping tool 12 is pivoted all the way back at the end of the dipper stick 24, and extended out as far forward of the chassis 14 as possible. The tool 12 is then lowered until the first tooth 62A of the first tooth set 60 engages the substrate, S. The rock ripping tool 12 is then drawn downward, and in ripping motion, the second tooth, i.e. the tooth 62B next adjacent to tooth 62A, engages the substrate. Looking at the first tooth and the second tooth together, the first tooth engages with the hard packed substrate with full breakout force. When the second tooth engages the substrate, some of the load is shared with the first tooth. As the tool is rolled forward, the third tooth 62C of first tooth set 60 then engages the substrate, S, and the load is shared between the several teeth that have engaged with the substrate. Throughout a good portion of the digging of the medium hard rock substrate, the tool 12 will have only one or two teeth engaged at any one instant due to the rolling operation of the bucket, thus always providing high forces for simplifying the excavation of the hard material.

Figure 7:
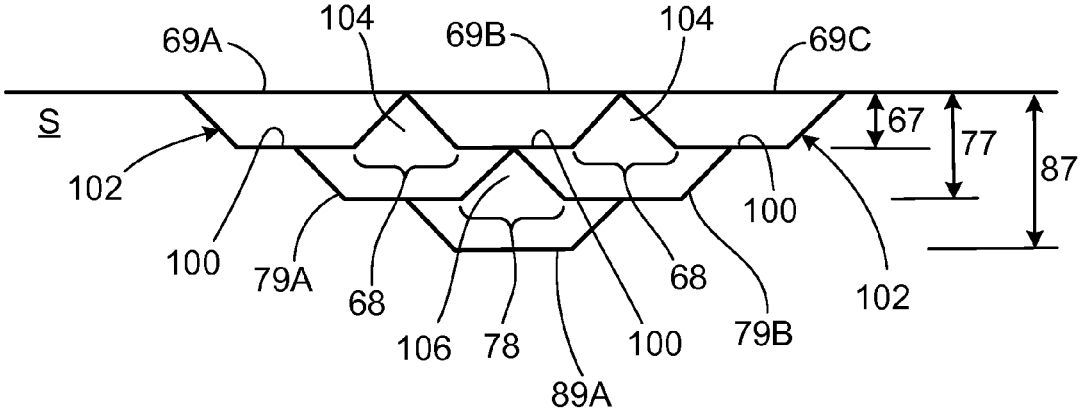
FIG. 7 is a schematic representing a cross-sectional view of a pattern of substrate material ripped from a substrate during use of a high production rock ripping tool of the disclosure.

Referring to FIG. 7, there is shown a cross-sectional schematic representation of the pattern of profiles by which substrate, S, is ripped. Since, as described above, no two teeth are in alignment, when the high production rock ripping tool 12 is rolled, each tooth engages separately, so that each tooth portion fractures the groove cut by the preceding ripper tooth or teeth. The top three trapezoidal shapes 69A, 69B, 69C represent the profile of material removed from the substrate, S, by the three teeth 62A, 62B, 62C of the first tooth set 60, located on the front leading edge 54, after the tool 12 has been rotated and translated over the medium hard rock material. The flat bottom 100 of each trapezoid-shaped profile indicates the result following the cutting action of each tooth in the first tooth set 60, and the angled sides 102 represent the broken out material. The flat bottoms 100 of the top profiles are at a depth, 67, from the surface of the substrate. After the first three teeth 69A, 69B, 69C have passed, the teeth have left the two raised grooves of material 104 located in the gaps 68.

The next two lower profiles 79A, 79B represent the next two teeth 72A, 72B of the second tooth set 70 passing through, ripping out the grooves with a deeper cut of relatively larger radius, removing the sections of material 79A, 79B to a depth 77. The two teeth 72A, 72B also remove the raised grooves of material 104 in gaps 68 while leaving a new raised portion 106 between the sections of material 79A, 79B, in the gap 78. The bottom shape or profile 89A represents the final, deepest cut, performed by rear tooth 82A of the third tooth set 80, with the relatively largest radius R3, which removes material to the lowest depth, 87, while also removing the raised groove of material 106. Once all the teeth have engaged and cut through the substrate, S, a staggered form of a "V" shape or profile has been cut into the substrate material (e.g., rather than a flat bottom).

The rear tooth can also be used as a pick when the tool is in the rolled forward position.

A number of embodiments of the disclosure have been described. Nevertheless, it will be understood that various modifications may be made without departing from the spirit and scope of the disclosure. For example, six teeth are described in one implementation of a high production rock ripping tool of this disclosure. In other implementations, more than or less than six teeth may be employed, positioned upon the surface of the tool. For example, four teeth may be positioned in the first tooth set 60 on the front leading edge 54. In this implementation, the number of teeth in the second group 70 could still be two, and the third tooth set 90 could still include a single tooth in the center, for a total of seven teeth.

Also, other arrangements of the teeth in the sets of teeth may be employed. For example, although in the implementation of the disclosure shown in the drawings the right outboard tooth 62A is forward, left outboard tooth 62C is rearward, and intermediate or central tooth 62B is in the middle, other arrangements may be employed according to the disclosure. For example, the center tooth 62B could be the first engaging tooth, with the right tooth 62A engaging next, followed by the left tooth 62C.

Referring to FIGS. 3-6, in a preferred implementation, a lower portion 47 of the curved back plate 42 has an outer surface 49 with a radius R4 having a center, A, that is co-axial with respective arcs 66, 76, 86 of the sets of tooth tips. This feature makes it easier to position and attach the tooth adaptors 92, 94 (or shanks) for teeth 72A and 72B on the curved back plate 42, and also helps to keep the shanks as short as possible, which serves to reduce stresses on the curved back plate. This arrangement also reduces wear on the outer and bottom surfaces of the bucket 12 because as the bucket moves parallel to the ripped rock surface of the substrate forming the bottom of the trench, the bottom surface of the bucket is less exposed for scraping engagement along the bottom of the trench. In contrast, bottom surfaces of some buckets of conventional design have a "heel" configuration that wears quickly due to its exposure and due to its tendency for scraping engagement along the substrate surface forming the bottom of the trench.

Also, in the implementation of the disclosure shown in the drawings, the high production rock ripping tool 12 is represented as being a bucket; however, other implementations are also possible. For example, rather than a closed bucket with side and bottom plates supporting attached teeth, a set of shanks could instead be attached to the tool body upper portion 34 in an arrangement to rip the substrate, S. For example, the teeth in a first set of staggered teeth 60 positioned relative to the axes of rotation and to the other teeth as described above may each be mounted to the end region of a shank. A second set of staggered teeth 70 that rip between, and deeper than, the first set 60 may also be mounted on shanks, and then a final tooth or set 80 positioned to rip between, and deeper than, the second set 70 would be mounted on still another shank. Each set of subsequent ripping teeth would rip on a relatively larger radius between the previous teeth, e.g. as described above.

Accordingly, other embodiments are within the scope of the following claims.

What is claimed is:

1. A rock ripping tool mountable to an arm of an excavation machine for ripping engagement with a substrate, the rock ripping tool comprising:

a tool body mounted for rotation from the arm;

a pair of side plates and a curved back plate mounted to the tool body;

a bottom plate, comprising one or more bottom plate segments, having an angled front leading edge and mounted to span a space between the side edge plates; and a plurality of teeth, comprising:

a first set of two or more teeth mounted to the angled front leading edge such that the tips of each of the teeth of the first set of two or more teeth lies on an arc having a first radius, a second set of one or more teeth mounted to at least one of the bottom plate and/or the back plate, such that the tips of each tooth of the second set of one or more teeth lies on an arc having a second radius greater than the first radius, wherein a lower portion of the back plate defines an outer surface lying on a radius having a center coaxial with at least one of the first radius and the second radius, and wherein each tooth of the plurality of teeth is configured to engage the substrate sequentially and individually from each of the other teeth.

2. The rock ripping tool of claim 1, wherein the first radius and the second radius intersect at a common axis of the ripping tool.

3. The rock ripping tool of claim 1, comprising at least a third set of one or more teeth mounted to the bottom plate and/or the back plate, such that the tips of each tooth of the third set of one or more teeth lies on an arc having a third radius greater than the first radius and greater than the second radius.

4. The rock ripping tool of claim 1, wherein each tooth of the plurality of teeth is angled such that an angle between a line bisecting the tooth and a line perpendicularly bisecting the respective arc where the tip of the tooth lies on the arc is at an optimum angle.

5. The rock ripping tool of claim 4, wherein the optimum angle is in the range of about 35° to about 70°.

6. The rock ripping tool of clam 5, wherein the optimum angle is approximately 50°.

7. The rock ripping tool of claim 4, wherein each tooth in the plurality of teeth is at the optimum angle.

8. The rock ripping tool of claim 7, wherein the optimum angle is in the range of about 35° to about 70°.

9. The rock ripping tool of clam 8, wherein the optimum angle is approximately 50°.

10. The rock ripping tool of claim 1, wherein the second set of teeth rips the substrate in a path between the paths of the teeth of the first set of two or more teeth.

11. The rock ripping tool of claim 1, wherein the side plates have leading edges that define cutting profile edges.

12. A rock ripping tool having a tool body and mountable to an excavation machine for ripping engagement with a substrate, the rock ripping tool comprising:

a pair of side plates and a curved back plate mounted to the tool body;

a bottom plate, comprising one or more bottom plate segments, having an angled front leading edge and mounted to span a space between the side edge plates; and a plurality of teeth, comprising:

a first set of teeth comprising at least two teeth mounted to the tool body such that the tips of each of the at least two teeth of the first set of teeth lie on an first arc having a first radius; and a second set of teeth comprising at least one tooth mounted to the tool body such that the tips of each of the at least one tooth of the second set of teeth lie on an second arc having a second radius greater than the first radius, wherein a lower portion of the back plate defines an outer surface lying on a radius having a center coaxial with at least one of the first radius and the second radius, and wherein each tooth of the plurality of teeth is configured to engage the substrate independently from each tooth in the first set of teeth and each tooth in the second set of teeth.

13. The rock ripping tool of claim 12, comprising at least a third set of one or more teeth mounted to the bottom plate and/or to the back plate, such that the tips of each tooth of the third set of one or more teeth lies on an arc having a third radius greater than the first radius and greater than the second radius.

* * * * *